US007201296B2

(12) United States Patent
Graf

(10) Patent No.: US 7,201,296 B2
(45) Date of Patent: Apr. 10, 2007

(54) DOSING DEVICE WITH A PUMPING DEVICE

(75) Inventor: Lothar Graf, Gottmadingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 10/490,531

(22) PCT Filed: Sep. 17, 2002

(86) PCT No.: PCT/EP02/10398

§ 371 (c)(1),
(2), (4) Date: Mar. 19, 2004

(87) PCT Pub. No.: WO03/026803

PCT Pub. Date: Apr. 3, 2003

(65) Prior Publication Data

US 2004/0256414 A1 Dec. 23, 2004

(30) Foreign Application Priority Data

Sep. 21, 2001 (DE) ..... 101 48 899
Apr. 20, 2002 (EP) ..... 02008877

(51) Int. Cl.
*B65D 88/054* (2006.01)
*B67B 5/00* (2006.01)
*A47G 19/00* (2006.01)

(52) U.S. Cl. ..... 222/321.9; 222/153.09; 222/321.2; 222/325; 222/470

(58) Field of Classification Search ..... 222/152, 222/153.1, 153.09, 321.6, 321.9, 321.2, 321.1, 222/372, 470, 323, 324
See application file for complete search history.

(56) References Cited

U.S. PATENT DOCUMENTS

| | | | | |
|---|---|---|---|---|
| 4,174,055 | A | 11/1979 | Antenore et al. | |
| 4,369,900 | A | 1/1983 | Saito et al. | |
| 4,371,097 | A | 2/1983 | O'Neill | |
| 4,830,284 | A | 5/1989 | Maerte | |
| 4,944,429 | A * | 7/1990 | Bishop et al. | 222/153.13 |
| 5,031,800 | A * | 7/1991 | Brunet | 222/153.06 |
| 5,127,548 | A * | 7/1992 | Brunet et al. | 222/80 |
| 5,351,863 | A | 10/1994 | Cecil et al. | |
| 5,769,274 | A | 6/1998 | Behar | |
| 5,860,569 | A * | 1/1999 | Gregoire | 222/129 |
| 6,050,457 | A | 4/2000 | Arnold et al. | |
| 6,059,151 | A * | 5/2000 | Fuchs | 222/321.6 |
| 6,250,509 | B1 | 6/2001 | Fuchs | |
| 6,276,568 | B1 | 8/2001 | Brotspies et al. | |
| 6,412,659 | B1 * | 7/2002 | Kneer | 222/82 |

FOREIGN PATENT DOCUMENTS

| | | |
|---|---|---|
| DE | 297 17 240 | 11/1997 |
| EP | 0 000 313 | 1/1979 |
| WO | 00/49988 | 8/2000 |

* cited by examiner

*Primary Examiner*—Eric Keasel
*Assistant Examiner*—M A Cartagena
(74) *Attorney, Agent, or Firm*—Flynn, Thiel, Boutell & Tanis, P.C.

(57) ABSTRACT

1. A dosing device with a pump device.
2.1. A dosing device with a pump device and with an operating handle which is provided for the pump device is known.
2.2. According to the invention, the operating handle (20, 20*a*, 20*b*) is produced as a separate component and fixed to the pump device.
2.3. Applicable for pharmaceutical agents.

12 Claims, 5 Drawing Sheets

Figure 1:
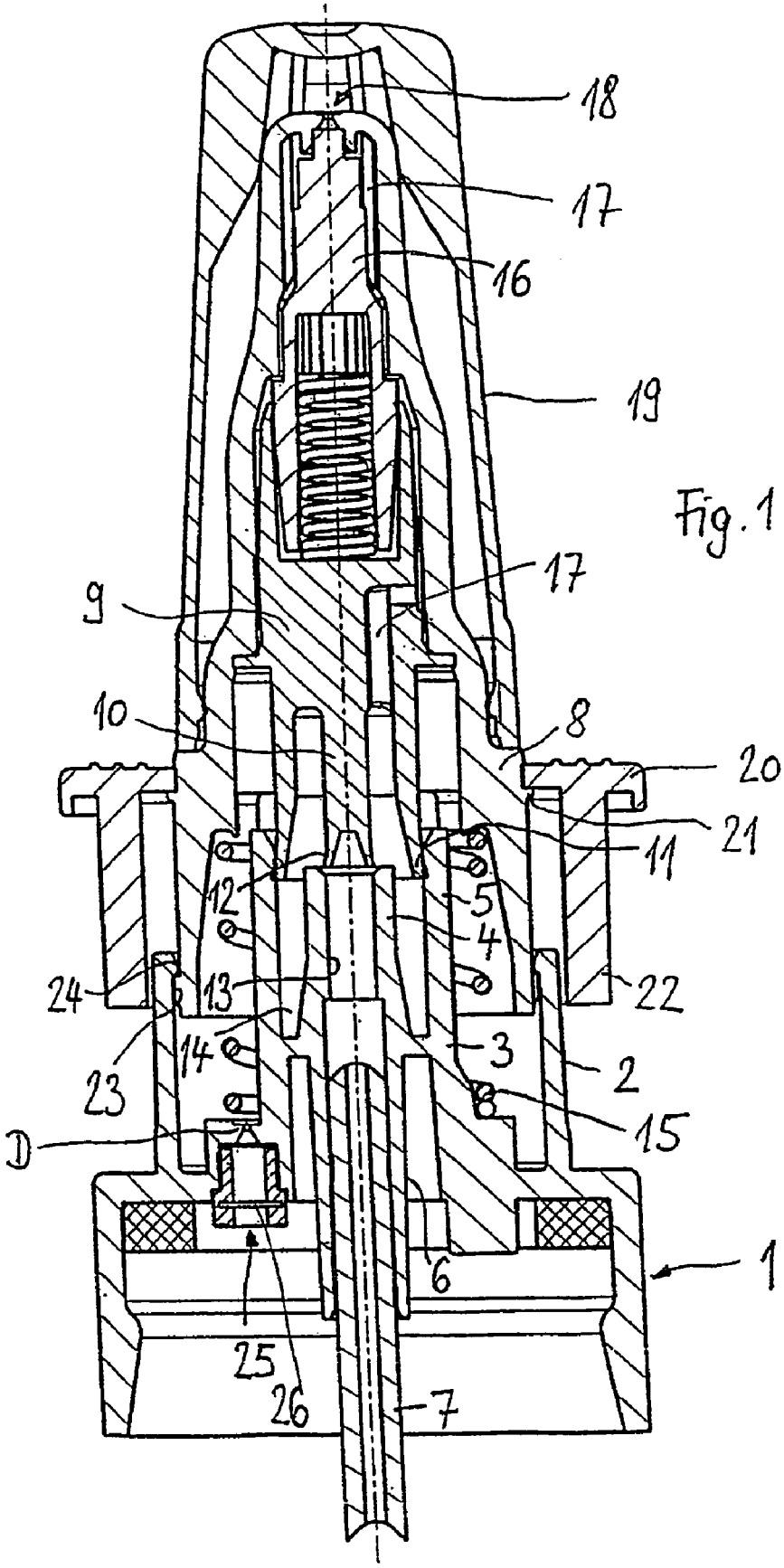

21b
24b
23b
2b
3b
25b

DOSING DEVICE WITH A PUMPING DEVICE

The invention relates to a dosing device with a pumping device and an operating handle associated with the pumping device.

Dosing devices for media are known, whose pumping devices can be manually operated by a corresponding operating handle. Such operating handles are shaped in one piece onto a corresponding housing part of the pumping device. In this connection reference is more particularly made to DE 33 15 334 A1, which discloses the integral shaping of an operating handle onto a housing body constructed as a nose olive.

The problem of the invention is to provide a dosing device of the aforementioned type, which involves reduced manufacturing costs.

This problem is solved in that the operating handle is manufactured as a separate component and is fixed to the pumping device, which makes it possible to fit the operating handle as the final component to the pumping device. Final assembly can in particular be carried out by the user, so that it is possible to pack the operating handle with the dosing device in the unfitted state, so that there is a smaller packing volume. There is no need for the dosing device manufacturer to carry out assembly.

According to a development of the invention the operating handle is fixed by a locking connection to the pumping device. Preferably the locking connection is designed as a detachable connection. This type of connection between the operating handle and the pumping device allows a simple and in particular tool-free assembly, e.g. by the user. However, it is simultaneously suitable for transferring adequate forces of said operating handle to the pumping device. As a result of the non-detachability of the connection between the operating handle and the pumping device it is possible both to introduce an operating force in order to bring about a discharge stroke and also a force acting in the opposite direction. Thus, not only can a discharge stroke be produced manually, but also a corresponding return stroke. At the same time the manufacture of the non-detachable connection also provides protection against subsequent manipulation.

Advantages result from developments of the invention in which the operating handle is constructed as a shaped body at least zonally surrounding the medium reservoir. For this purpose and according to a preferred development the shaped body has a substantially cylindrical basic shape. Alternatively it is possible for the shaped body to have divergences from the cylindrical basic shape, e.g. a relief structure or in place of the purely cylindrical basic shape a cross-sectionally oval or elliptical basic shape. The faces of the cylindrical basic shape can be given an open construction. The other face facing said first face can be at least substantially closed and have an opening for mounting on the pumping device.

It is advantageous in such developments if the external configuration of a dosing device can at least partly be determined by the operating handle. It is easily modified without anything having to be changed on the structure of the dosing device, the pumping device or the design thereof. Thus, it is advantageous to have a separation of the functional components and the operating handle which is decisive for the design, so that different operating handles can be used, as desired, for the same functional device. Different designs merely exist with respect to the in any case separately fittable operating handle. The design modifications can relate both to the colouring and to the shaping. Thus, different colours are possible, so that it is possible to distinguish from one another dosing devices for different persons or with different contents. Multicomponent injection mouldings with different haptic designs can be used with particular advantage. In particular, different material components such as PP or TPE can be supplied by different extruders to a correspondingly adapted injection mould, so that as a function of requirements it is possible to create smooth velvet-like, good gripping areas with respect to the operating handle. It is also possible, e.g. for children, to give a coloured and/or figurative design to the shaped body. Such designs are particularly attractive to children and consequently provide a supplementary motivation for the use of the dosing device.

According to a preferred development, to a component of the pumping device can be detachably fixed a protective cap at least surrounding a discharge opening, said cap being so matched to the operating handle shape that even when the cap is fixed the handle can be engaged on the pumping device. Thus, prior to the fitting of the operating handle, there is no need to remove the protective cap from the pumping device.

On fitting the operating handle, it can be advantageous to have already performed a discharge stroke. To the extent that the pumping device requires priming at the start of its use before a medium is discharged, unconsciously a discharge stroke can be produced on fitting the handle, so that the number of further strokes necessary for priming is reduced. Priming is the filling of the pump chamber of the pumping device with medium from the medium reservoir to ensure that there has in fact been a medium discharge with the desired dose through the discharge opening.

Further advantages and features of the invention can be gathered from the claims and the following description of preferred embodiments of the invention with reference to the attached drawings, wherein show:

FIG. 1 In a longitudinal section an embodiment of a dosing device with a pumping device and a pressure compensating device.

Figure 2:
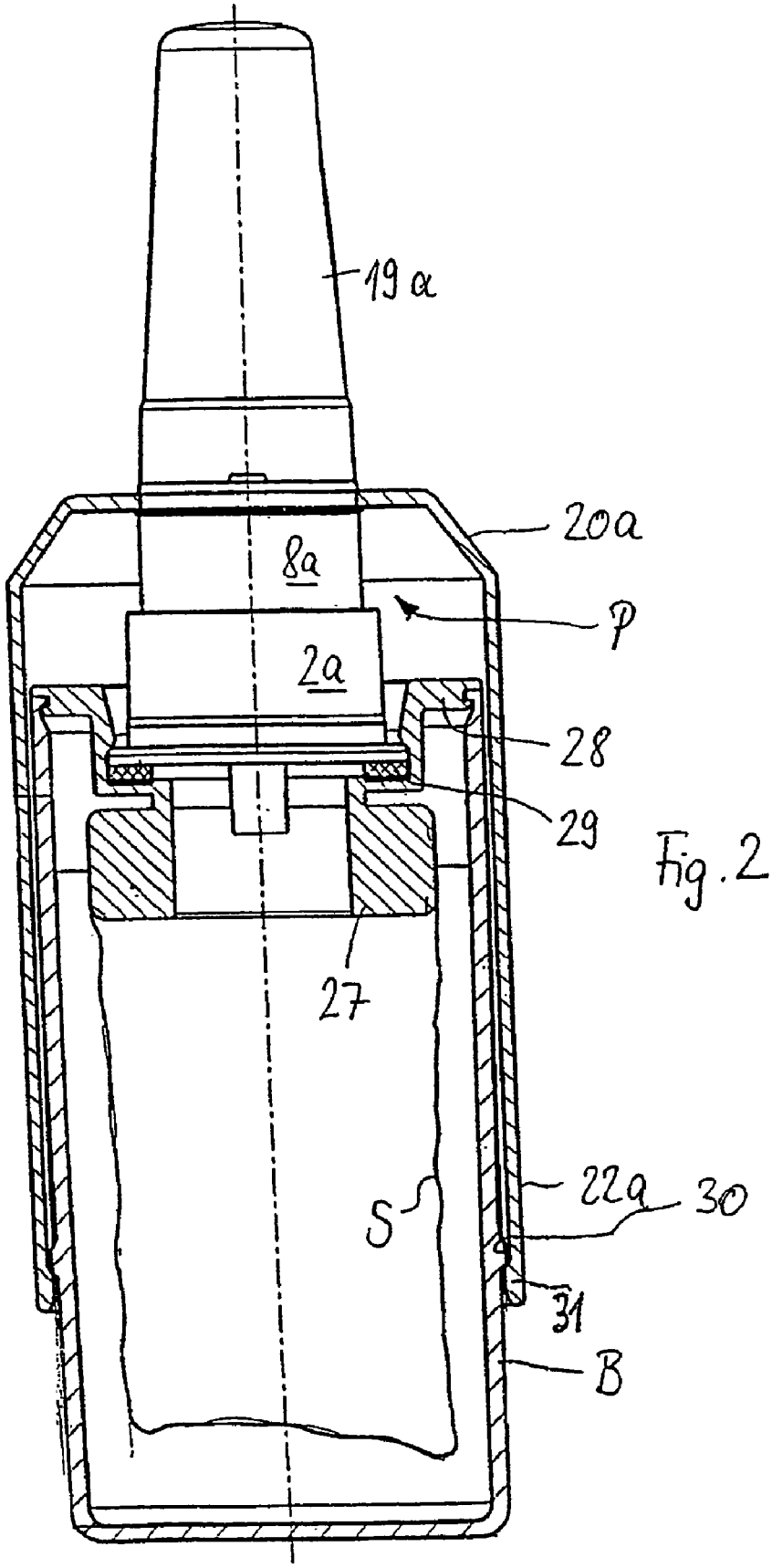

FIG. 2 Another embodiment of a dosing device with a flexible wall medium reservoir and a pumping device similar to FIG. 1.

Figure 3:
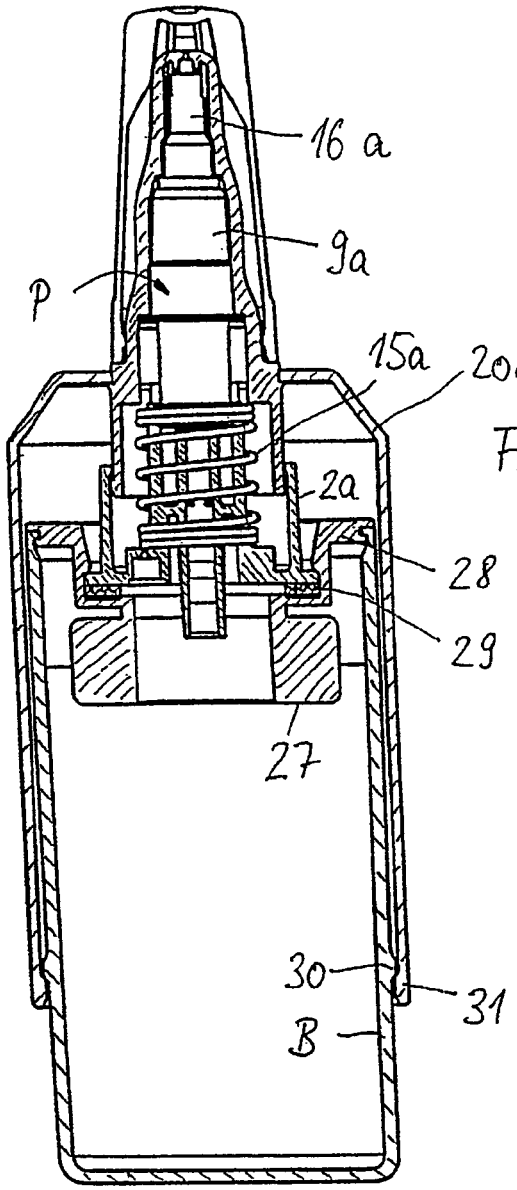

FIG. 3 The dosing device in FIG. 2 in longitudinal section.

Figure 4:
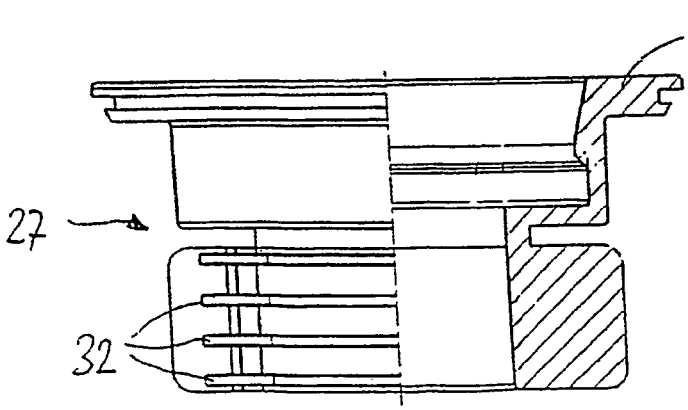

FIG. 4 A larger scale representation in half-section form of a reception unit of the dosing device according to FIG. 3 serving as a cover.

Figure 5:
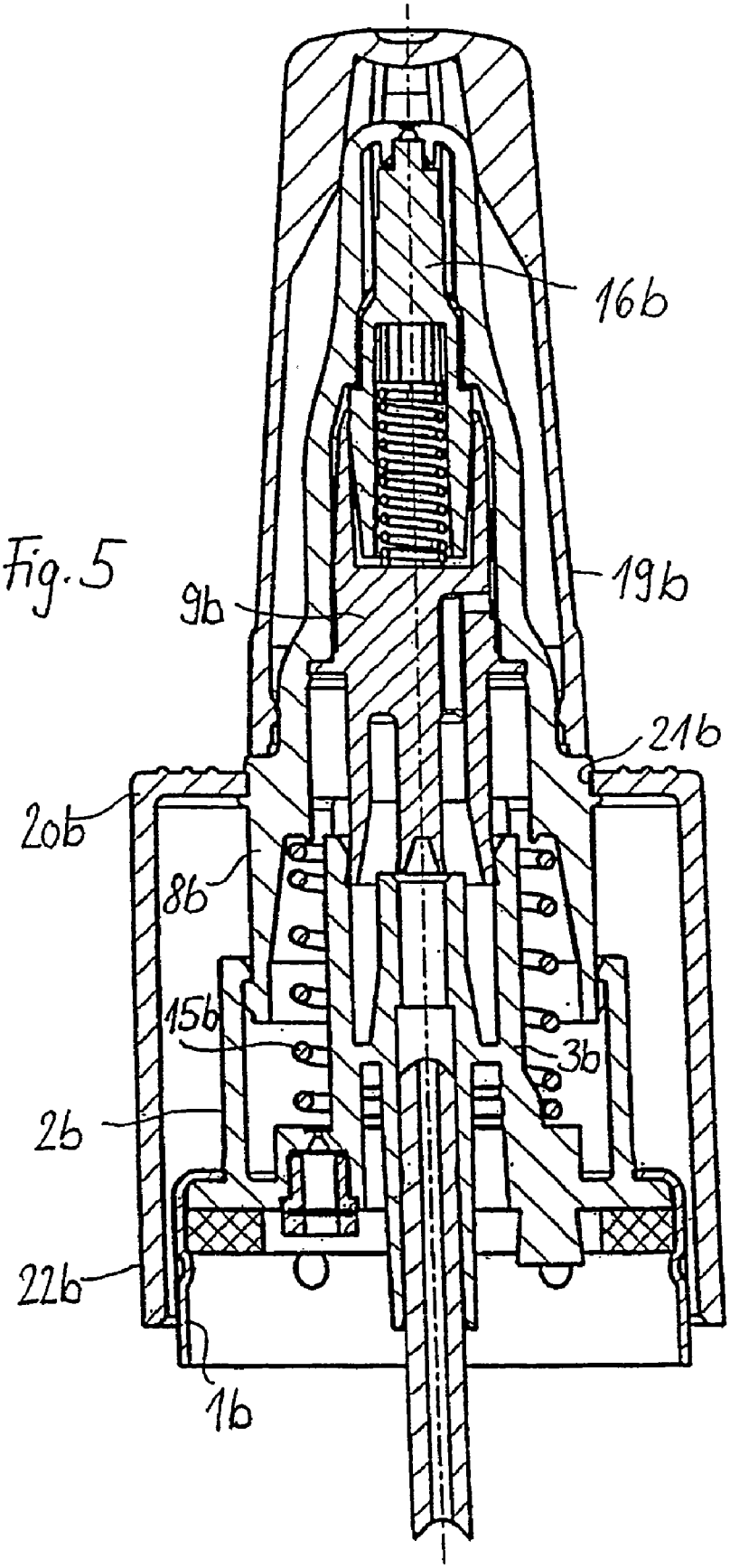

FIG. 5 A longitudinal section through a dosing device similar to FIG. 1.

Figure 6:
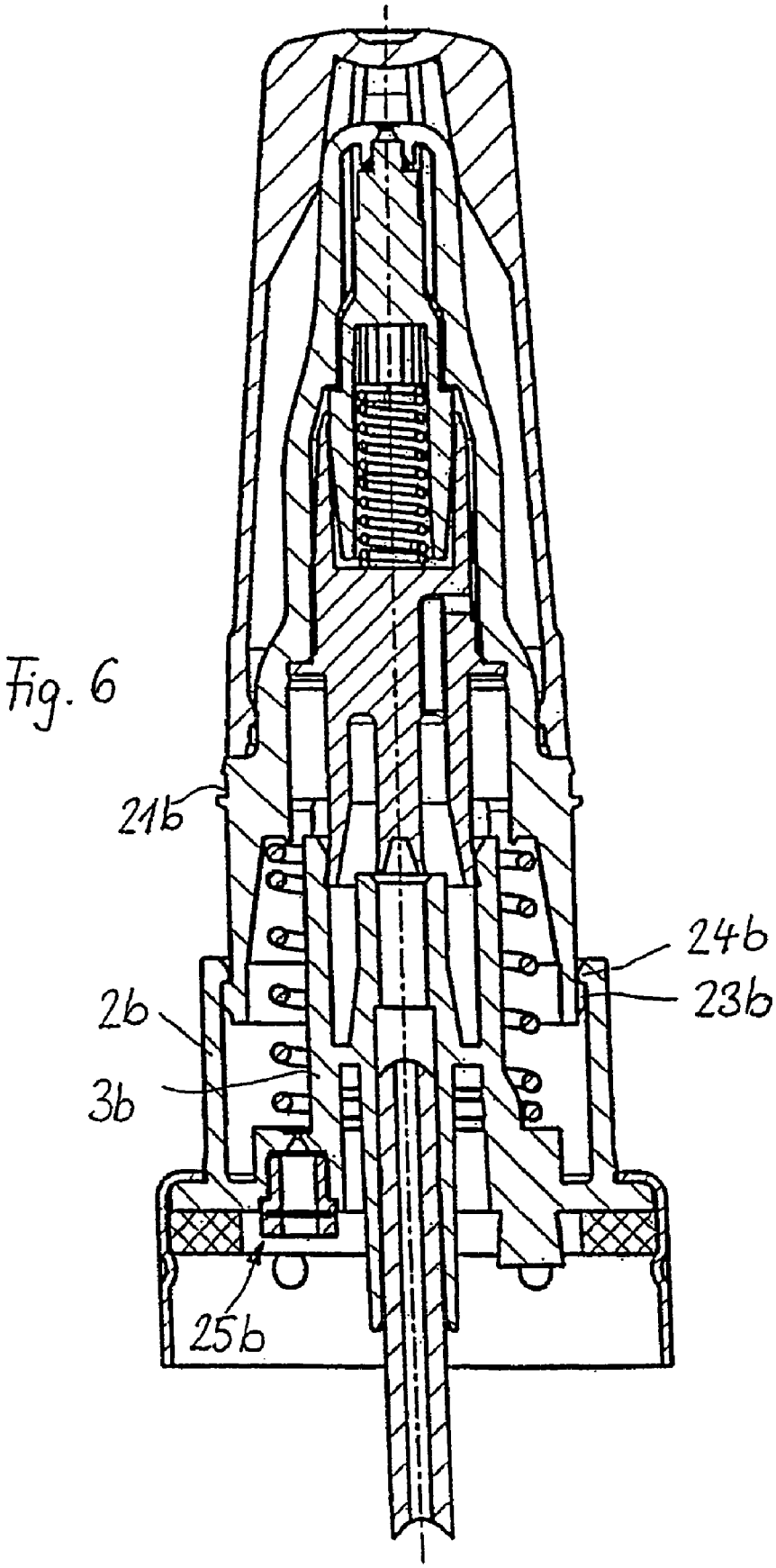

FIG. 6 The dosing device of FIG. 5 with the operating handle removed.

A dosing device according to FIG. 1 has a cover 1, which can be locked onto a medium reservoir, preferably the form of a bottle-like or can-like container. For this purpose the cover 1 is cup-shaped and has on its inner circumference a not further designated annular shoulder, which can be locked onto a corresponding annular flange in a neck area of the medium reservoir. In an upper area of the cover 1 is provided a not designated, circumferential, elastic seal, which is compressed on locking the cover 1 on the medium reservoir neck and consequently ensures a tight sealing of the medium reservoir. A cup-like reception part 2 is integrally shaped onto the cover 1 and projects upwards counter to the not shown medium reservoir coaxial to a centre line axis of the cover 1. The reception part 2 forms an outer, jacket-like casing part for a subsequently further described pumping device, which is part of the dosing device of FIG. 1. A fixed pump casing part 3 is also provided integrally and projecting from the cover 1 and in fact coaxially within the reception part 2 and said part 3 is provided with a discharge channel 6 coaxially to the centre line axis of the cover 1 and said channel is open both downwards to the medium reservoir and upwards towards a dosing opening 18. In a lower portion of the discharge channel 6 is inserted a fundamentally known, preferably flexible suction connection 7. An upper portion of the discharge channel 6 is in the form of a dosing segment 13, in that said upper portion, starting from a stepped taper of the discharge channel 6, constitutes a cylindrical dosing channel with a reduced diameter compared with the lower portion of the discharge channel 6. The dosing segment 13 in the form of a dosing channel is surrounded by an inner cylinder jacket 4.

In radially spaced manner with respect to the inner cylinder jacket 4, the inner pump casing part 3 forms an outer cylinder jacket 5 which, like the inner cylinder jacket 4, is integrally shaped onto the cover 1. The outer cylinder jacket 5 is oriented coaxially to the inner cylinder jacket. Between the inner cylinder jacket 4 and the outer cylinder jacket 5 is left an annular displacement area 14, to which further reference will be made hereinafter and which forms part of a pump chamber.

Relative to the reception part 2 fixable in secured manner to the medium reservoir, including the inner pump casing part 3, is mounted in lift-movable or stroke-movable manner a pump unit. The stroke-movable pump unit has an outer pump casing part 8, which is firmly connected to an inner pump plunger or piston unit 9 to 11. The pump plunger unit 9 to 11 is manufactured separately as an integral component and is locked in the interior of the outer pump casing part 8. The pump plunger unit has a plunger body 9, which forms in an upper area a cylinder space for a coaxially positioned, stroke-movable outlet valve 16. The outlet valve 16 is so pressure-loaded in the closing direction by a compression spring arrangement, here in the form of a not further designated helical compression spring, that the plunger-like outlet valve 16 closes the outlet opening 18. The compression spring arrangement is placed in the interior of the plunger-like outlet valve 16 and is supported on a base of the cylinder space of the plunger body 9. The cylinder space of the plunger body 9 is provided in its upper marginal area with a circumferential sealing lip, which engages in circumferentially tight manner on the outer jacket of the plunger-like outlet valve 16. As a result the cylinder space and consequently also the reception space for the compression spring arrangement is sealed against the penetration of a medium, particularly a liquid. The outlet valve 16 is at the same time constructed as a filler, in that it almost completely fills the outer pump casing part 8. The plunger body 9 is also designed as a filling member, in that its outer contour is largely adapted to the inner contour of the outer pump casing part 8.

In the plunger body 9 is formed a first portion of an outlet chamber 17 belonging to the pump chamber and which is open to the displacement area 14 and dosing segment 13. Said first portion is radially outwardly open in its upper area and passes into an annular chamber portion of the outlet chamber 17, which is formed between the outer jacket of the plunger body 9, the outer contour of the outlet valve 16 and the inner contour of the outer pump casing part 8. As a result of the locking connection of the plunger body 9 in an annular locking flange area with the outer pump casing part 8, the annular chamber portion is axially downwardly closed. In the direction of the outlet opening 18, the outlet valve 16 closes the annular chamber portion of the outlet chamber 17.

In a lower area the plunger body 9 forms a coaxially inner valve plunger 10, which together with the inner cylinder jacket 4 in the vicinity of the dosing segment 13 forms an inlet valve, in the form of a slide valve, for the pumping device. For this purpose the valve plunger 10, which is integrally shaped onto the plunger body 9, is provided in a lower area with an annular dosing lip 12, which engages tightly on an inner wall of the dosing channel forming the dosing segment 13 on introducing the valve plunger 10 into said dosing segment 13. The diameter of the dosing lip 12 is larger than the diameter of the valve plunger 10. The length of the valve plunger 10 and the stroke of the plunger body 9 and consequently the entire, stroke-movable pump unit are dimensioned in such a way that the dosing lip 12 in an upper opening position shown in FIG. 1 is positioned a short distance above the dosing segment 13. In a lower, completely downwardly pressed end position of the stroke-movable pump unit, the dosing lip 12 is introduced into the stepped widening of the discharge channel 6, i.e. it has moved downwards over and beyond the dosing segment 13. As the external diameter of the dosing lip 12 is smaller than the diameter of the discharge channel 6 in the stepped widened area and the diameter of the valve plunger 10 is smaller than the internal diameter of the dosing segment 13, in said lower end position of the pump unit there can be a medium exchange between the outlet chamber 17 and the medium reservoir, via the suction connection 7.

Coaxially and in radially spaced manner the valve plunger 10 is surrounded by a bell-like displacement plunger 11, which by means of a lower sealing edge is engaged in circumferentially tight manner on an inner wall of the annular displacement area 14. The cross-section of the bell-shaped displacement plunger 11 is adapted to the cross-section of the displacement area 14 in such a way that in the downwardly moved end position of the plunger body there is virtually no clearance volume in the displacement area, because in this position the displacement plunger 11 is completely introduced into the displacement area 14. The annular space between the outer wall of the valve plunger 10 and the inner wall of the displacement plunger 11 has its volume matched to the body volume of the inner cylinder jacket 4, so that the remaining clearance volume is further reduced in the case of a downwardly moved pump unit. In the vicinity of its outer jacket, the plunger-like outlet valve 16 is provided with several annular steps, which form pressure application faces for opening the outlet valve 16. The protective cap 19 has a conically downwardly widening bell shape, which is inverted over an upper shaped section of the outer pump casing part 8 and comes to rest axially on an annular shoulder ledge of the pump casing part 8. The protective cap is manually detachably locked onto the shaped section of the pump casing part 8. The external diameter of the protective cap 19 is smaller than the maximum external diameter of the pump casing part 8. The upper shaped section of the pump casing part 8 is designed as a nose olive, in order to permit application to the nose of the medium contained in the medium reservoir. Preferably the medium stored in the medium reservoir contains at least one pharmaceutical substance.

On an outer jacket area of the outer pump casing part 8 is locked an operating handle 20, which is provided on its top on at least two opposite sides with in each case one finger rest. In FIG. 1 the finger rests are provided with profiles. For axially securing the operating handle 20, a circumferential locking web 21 is provided on the outer circumference of the pump casing part 8 and above which is associated at least one locking groove in which are axially engaged the corresponding inner marginal portions of the operating handle 20. The operating handle 20 is preferably locked on the pump casing part 8 by means of a non-detachable locking connection, i.e. following the axial locking of the operating handle 20 it is no longer possible to remove it without destruction from the pump casing part 8.

Below the locking web 21 the pump casing part 8 has a cylindrical guide jacket, which is provided in its lower marginal area with several stop cams 23 distributed at the same height over the outer circumference of the guide jacket and which cooperate with a radially inwardly projecting, circumferential locking collar 24 of the jacket-like or cup-like reception part 2. The locking cams 23 and locking collar 24 form locking profiles, which ensure the axial securing of the stroke-movable pump casing part 8 on the fixed reception part 2. The locking profiles 23, 24 axially retain the pump casing part 8 counter to the compressive force of a pump spring arrangement 15, which serves as a pump drive for the resetting of the stroke-movable pump unit into the starting position of FIG. 1. A manual pressing down of the pump unit consequently takes place counter to the compressive force of the pump spring arrangement 15. As can be gathered from FIG. 1, the pump spring arrangement 15 is positioned outside the outer cylinder jacket 5 of the inner, fixed pump casing part 8, so that the pump spring arrangement 15 is located outside the pump area through which the medium flows. Thus, it is not possible for the pump spring arrangement 15 to be in contact with the medium, e.g. a liquid containing at least one pharmaceutical substance.

The operating handle 20 has an annular securing extension 22, which as a cylinder jacket projects downwards and in the upper end position of the pump unit shown in FIG. 1 projects axially over the reception part 2 to the extent that it overlaps the area of the locking profiles 23, 24. The distance from the outside of the reception part to the inner wall of the protective extension 22 is preferably smaller than the radial extension of the locking profiles 23, 24, so that the rigid, annular protective extension 22 provides a protection against a detachment of the locking profiles 23, 24 and therefore serves as a removal preventer for the pump casing part 8.

As the cover 1 in conjunction with the previously described pumping device tightly seals a container serving as a medium reservoir, in the case of corresponding pumping processes there must be a pressure compensation in order not to impair the function of the pumping device. In the embodiment shown a pressure compensating device 25, 26, D is provided for this purpose and is integrated into the cover 1. The pressure compensating device has a nozzle hole D tapering in a pronounced manner to the outside and serving as a pressure compensating opening, whose narrowest diameter preferably does not exceed 0.2 mm to 0.3 mm. This ensures a gas exchange, whereas a liquid loss is minimized due to the extremely small nozzle hole D. This leads to a reduced evaporation, which is particularly advantageous for the filter arrangement 25 additionally provided in FIG. 1. The filter arrangement 25 has a not further designated reception housing for a membrane-like filter 26. The reception housing is inserted in a corresponding receptacle of the cover 1 and is preferably bonded into the same or is fixed thereto in some other way. The membrane-like filter 26 is extruded round by the reception housing in the embodiment shown and is consequently integrated into the same. It is alternatively possible to laminate the membrane-like filter 26 on an upper front edge of the reception housing. The membrane-like filter is preferably a PP/PTFE membrane or a TPE/PES membrane. The filter 26 serves to prevent contamination of the medium in the medium reservoir, in that the atmospheric air sucked for pressure compensation purposes through the nozzle hole D in the case of a corresponding pumping process is cleaned or purified by the corresponding membrane. Thus, the entry of water or moisture is prevented by the filter arrangement 25.

The function of the dosing device shown in FIG. 1 will now be described. The inlet valve formed by the valve plunger 10 in conjunction with the dosing lip 12 and dosing segment 13 operates in the case of a manual operation of the operating handle 20 as a slide, in that the outer pump casing part 8 together with the pump unit 9 to 11 is moved downwards. Due to the fact that in the case of a complete stroke of the pump unit the dosing lip 12 passes downwards below the dosing segment 13 and therefore below the stepped ledge in the discharge channel 6 into the open, a so-called priming is made possible. This means that the air in the pump area of the pumping device defined by the outlet chamber 17, the displacement area 14 and the annular space between the inner valve plunger 10 and the outer displacement plunger 11, during a stroke movement of the pump unit can escape downwards into the discharge channel 6 and therefore into the suction connection 7 and medium reservoir. During the following return stroke the corresponding suction of the liquid medium takes place. Due to the extremely small clearance volume within the pump area of the pumping device serving as a pump chamber preferably a single stroke is sufficient for priming purposes in order to bring about an adequate suction of the medium to be dispensed in the pump chamber. The length of the stroke of the dosing lip 12 along the dosing segment 13 defines the dosing volume. The defined dosing segment 13 stepped in tapered manner with respect to the remaining discharge channel 6 in conjunction with the valve plunger 10 running downwards into the open in slide form makes it possible, even after the end of priming, i.e. following the complete filling of the entire medium path in the discharge channel 6, as well as in the pumping or dosing chamber of the pumping device, a particularly accurate and reliable dosing.

A discharge process takes place as soon as the liquid pressure in the pump chamber, i.e. particularly in the upper area of the outlet chamber 17, which acts on the plunger-like outlet valve 16, exceeds the counterpressure applied by the compression spring arrangement. The liquid pressure forces the outlet valve 16 downwards counter to the compressive force of the compression spring arrangement, so that the corresponding medium discharge process takes place via the outlet opening 18. The outlet opening 18 is preferably nozzle-shaped in order to bring about an atomization of the dispensed medium. Obviously, prior to a corresponding discharge process, the protective cap 19 is removed.

The dosing device shown in FIG. 1 comprises a few plastic components and at present of only six plastic components. A first plastic component is constituted by the cover 1 in conjunction with the reception part 2 and the inner pump casing part 3. The second plastic component is formed by the outer pump casing part 8. The third plastic component is the pump plunger unit 9 to 11. The fifth plastic component is the plunger-like outlet valve 16. The fifth plastic component is the operating handle 20 provided with the finger rests and the final plastic component is the protective cap 19. For assembling the dosing device firstly the plunger-like outlet valve 16 together with the compression spring arrangement acting thereon is inserted in the pump plunger unit 9 and then the latter together with the outlet valve 16 is locked in the interior of the outer pump casing part 8, so that an upper face of the outlet valve 16 is pressed against the corresponding valve seat in the vicinity of the outlet opening 18. Then the outer pump casing part 8, together with the pump plunger part 9 to 11, is axially inserted into the fixed plastic component, so that locking and axial securing take place in the vicinity of the locking profiles 23, 24. The operating handle 20 is now locked axially from above on the outer pump casing part 8, so that the locking connection and axial securing between the pump casing part 8 and reception part 2 of the cover 1 is covered and secured. The filter arrangement 25 and circumferential seal are inserted in the cover 1. The cover 1 can then be tightly engaged on a corresponding medium reservoir.

Prior to the axial engagement of the outer pump casing part 8 on the cover 1, the pump spring arrangement 15 is inserted.

In the embodiment according to FIGS. 2 to 4 a pumping device P corresponds to the pumping device described hereinbefore relative to FIG. 1, so that for a more detailed explanation of the pumping device P reference is made to the detailed description concerning FIG. 1. Identically functioning parts are given the same reference numerals compared with FIG. 1, but followed by the letter "a". Details will now only be given of differences between the pumping device P compared with the pumping device of FIG. 1. A description will also be given of the remaining dosing device in which the pumping device P is integrated. The essential difference compared with the embodiment of FIG. 1 is that the pumping device P can be manufactured as a separate subassembly with respect to the dosing device and is detachably connected thereto. In the embodiment according to FIGS. 2 to 4 the reception part 2*a* is admittedly in one piece with the inner pump casing part. The inner pump casing part, which is surrounded by the pump spring arrangement 15*a*, together with the reception part 2*a* nevertheless constitutes a unit separate from a cover 28 for a container cup P. The cover 28 has a sleeve-like or annular design and is provided with a reception depression into which can be locked the reception part 2*a* of the pumping device P by using a circumferential annular flange. For this purpose an edge of the reception depression is provided with an annular locking point, which is clearly visible in FIGS. 2 and 3, but is not further designated. A tight, clearance-free seating of the annular flange and therefore the reception part 2*a* in the reception depression of the cover 28 is ensured by an annular seal 29, which is positioned below the annular flange and rests on a dish edge of the annular reception depression of the cover 28. The cover 28 is a plastic part and is locked or firmly connected by crimping to an upper marginal area of the container cup B.

Below the dish edge of the reception depression, the cover 28 is provided by a profile ring 27 shaped in one piece and which as an extension to the cover 28 projects into the interior of the container cup B. As can be gathered from FIG. 4, the profile ring is provided with several parallel, spaced annular ribs 32, which project radially outwards to a centre line axis of the cover 28. There are also several vertical oriented rib webs extending over the height of the profile ring 27 and which are not further designated in FIGS. 2 to 4. These rib webs are distributed over the circumference of the profile ring 27. The sectional view of FIGS. 2 and 3 is in each case traversed by two such rib webs.

With respect to its pump operating function, the operating handle 20*a* for pumping device P corresponds to the operating handle 20 of FIG. 1. The operating handle 20*a* is additionally designed as a cup-shaped cylinder jacket, which axially engages over the container cup B by more than half of its height. The outer jacket of the container cup B and an inner wall of a lower marginal area of the cylinder jacket 22 of the operating handle 20*a* are provided with corresponding stop profiles 30, 31 which positively engage behind one another in the axial direction. This gives an axial securing action for the operating handle 20*a*. As the operating handle 20*a*, like the operating handle 20 of FIG. 1, is locked on the outer pump casing part of the pumping device P, the stop profiles 30, 31 simultaneously create the stroke limitation for the pumping device P, which offers the necessary retaining force against the compressive force of the pump spring arrangement 15.

The embodiment of FIG. 2 and the representation of FIG. 3 are slightly modified. Thus, in the embodiment according to FIG. 3 the reception part 2*a* of the pumping device P contains a receptacle for the insertion of a filter arrangement, as shown in FIG. 1. Thus, if the cover 28 provides a tight seal for the container cup B, the latter can be directly used as a medium reservoir for a corresponding liquid, because despite the dimensionally stable container cup B through the receptacle provided with the nozzle hole, optionally with the additional insertion of a filter arrangement, there is an adequate pressure compensation during the operation of the pumping device P.

However, in the case of FIG. 2 there is no such pressure compensating device for the container cup B. Instead the container cup B has a medium reservoir S with flexible wall. The medium reservoir S is here in the form of a film bag produced from a one or multiple-layer film, which is circumferentially tightly connected to the profile ring 27. Preferably the film bag is welded to the profile ring 27 and the profiles of the latter enlarge the surface for a tight welding of the film bag to the profile ring 27. This ensures excellent security of the welded the profile ring 27. This ensures excellent security of the welded connection and a tight sealing of the film bag with the profile ring 27. The film bag serving as a medium reservoir S is consequently only open to the pumping device P, so that the same pumping and discharge function can be obtained as in the embodiment of FIG. 1. With each discharge process there is a reduction of the volume of the medium reservoir S, so that the film bag contracts. The flexible film bag wall consequently permits a pressure and volume compensation within the medium reservoir S during corresponding discharge processes of the pumping device P.

In the embodiment of FIGS. 5 and 6 a dosing device is shown and its pumping device corresponds to that of FIG. 1. Parts of the dosing device having the same functions are given the same reference numerals as in the embodiment of FIG. 1, but followed by the letter "b". For further details reference is made to the description concerning FIG. 1. Hereinafter reference is made solely to the differences shown in FIGS. 5 and 6. The essential difference is that the reception part 2*b*, in much the same way as in the embodiment according to FIGS. 2 to 4 is designed separately with respect to a cover 1*b*. The cover 1*b* is in the form of a crimped cover, which can be mounted on a corresponding container neck of a medium reservoir. The mounting of the reception part 2*b* together with the cover 1*b* in the form of a crimped cover takes place accompanied by the interposing of a not designated, circumferential, elastic seal. The operating handle 20*b* has a cupshaped protective extension 22*b*, which is drawn downwards over the cover 1*b* in the form of a crimped cover, so that the protective extension 22*b* axially covers a crimped area of the cover 1*b* in the form of a crimped cover. This avoids a detachment of the cover 1*b* from a corresponding medium reservoir container neck as soon as the operating handle 20*b* has been locked on the outer pump casing part 8*b* of the pumping device in accordance with the representation and description according to FIG. 1. As the protective extension covers the crimped area of the cover 1*b*, the separately manufactured operating handle is only fitted on the pump casing part 8*b* when the cover 1*b* has been crimped onto a corresponding medium reservoir container neck, because a crimping process would not be possible when the operating handle 22*b* was already locked on.

The invention claimed is:

1. A dosing device comprising:

a pumping device; and an operating handle associated with the pumping device, wherein the operating handle is manufactured as a separate component from the pumping device and is fixed to the pumping device by a locking connection, and wherein the pumping device comprises:

a radially extending surface configured to axially engage the operating handle so that a manual operating force applied to the operating handle is transferred from the operating handle to the pumping device; and a retaining mechanism on the pumping device configured to axially engage the operating handle and, in cooperation with the radially extending surface, fix the operating handle to the pumping device, the retaining mechanism being a locking groove sized to receive a part of the operating handle therein to facilitate the locking connection, whereby the locking connection of the operating handle to the pumping device assembles the dosing device into an operational configuration, and wherein a protective cap surrounding at least one discharge opening of the pumping device is detachably fixed to the pumping device, the protective cap being substantially matched to the shape of the operating handle such that the operating handle is engageable on the pumping device even when the protective cap is fixed to the pumping device.

2. The dosing device according to claim 1, wherein the operating handle is non-detachably locked with the pumping device.

3. The dosing device according to claim 1, wherein the operating handle is constructed as a shaped body at least zonally surrounding a medium container of the pumping device.

4. The dosing device according to claim 3, wherein the shaped body has a substantially cylindrical shape, one face of the shaped body is open and an opposed face of the shaped body is substantially closed and has an opening for insertion of the medium container.

5. The dosing device according to claim 1, wherein the operating handle is constructed as a multicomponent injection moulding with areas with different haptic design.

6. The dosing device according to claim 1, wherein the radially extending surface comprises a circumferential locking web provided on an outer circumference of the pumping device.

7. A dosing device comprising:

a pumping device; and an operating handle associated with the pumping device, the operating handle being fixed to the pumping device by a locking connection, and wherein the pumping device comprises:

a radially extending surface configured to axially engage the operating handle so that a manual operating force applied to the operating handle is transferred from the operating handle to the pumping device; and a retaining mechanism on the pumping device configured to axially engage the operating handle and, in cooperation with the radially extending surface, fix the operating handle to the pumping device, the retaining mechanism being a locking groove sized to receive a part of the operating handle therein to facilitate the locking connection, whereby the locking connection of the operating handle to the pumping device assembles the dosing device into an operational configuration, and wherein a protective cap surrounding at least one discharge opening of the pumping device is detachably fixed to the pumping device, the protective cap being substantially matched to the shape of the operating handle such that the operating handle is engageable on the pumping device even when the protective cap is fixed to the pumping device.

8. The dosing device according to claim 1, wherein the operating handle is non-detachably locked with the pumping device.

9. The dosing device according to claim 7, wherein the operating handle is constructed as a shaped body at least zonally surrounding a medium container of the pumping device.

10. The dosing device according to claim 9, wherein the shaped body has a substantially cylindrical shape, one face of the shaped body is open and an opposed face of the shaped body is substantially closed and has an opening for insertion of the medium container.

11. The dosing device according to claim 7, wherein the operating handle is constructed as a multicomponent injection moulding with areas with different haptic design.

12. The dosing device according to claim 7, wherein the radially extending surface comprises a circumferential locking web provided on an outer circumference of the pumping device.

* * * * *